United States Patent [19]

Bittaker et al.

[11] 4,413,364

[45] Nov. 8, 1983

[54] TOILET LIGHT UNIT

[75] Inventors: Gerald W. Bittaker; Evidio E. Martinez, both of Miami, Fla.

[73] Assignee: Charlie I. Pearce, Miami Lakes, Fla.

[21] Appl. No.: 347,440

[22] Filed: Feb. 10, 1982

[51] Int. Cl.[3] ..... A47K 17/00

[52] U.S. Cl. ..... 4/661; 4/DIG. 6; 362/131; 362/191; 362/802

[58] Field of Search ..... 4/DIG. 6, 661, 233, 4/237; 362/101, 130, 131, 191, 253, 376, 382, 389, 397, 398, 457, 458, 802

[56] References Cited

U.S. PATENT DOCUMENTS

| | | | |
|---|---|---|---|
| 2,206,094 | 7/1940 | Hobbs | 362/394 X |
| 2,336,677 | 12/1943 | Frey | 362/394 |
| 2,763,773 | 9/1956 | Morente | 362/802 X |
| 3,045,096 | 7/1962 | Clayton | 4/237 X |
| 3,137,447 | 6/1964 | Dorman | 362/191 |
| 3,982,288 | 9/1976 | Borne | 4/237 |

FOREIGN PATENT DOCUMENTS

| | | | |
|---|---|---|---|
| 310358 | 12/1955 | Switzerland | 362/397 |

*Primary Examiner*—Charles E. Phillips
*Attorney, Agent, or Firm*—Oltman and Flynn

[57] ABSTRACT

The present toilet light unit has a miniature battery-powered lamp mounted on the top rear of a toilet bowl and controlled by a mercury switch on the toilet seat. The unit has a housing with a battery compartment at the back, a flat bottom wall covered by a self-adhesive layer for engagement with the top of a toilet bowl at the rear, and a depending front end segment which extends around the lamp at the front and sides and has rear edges for engagement with the rear inner edge of the toilet bowl. A socket for the lamp is carried by a holder which is removably attached to the bottom wall of the housing inside its depending front segment. The lamp socket has a terminal projecting up through an opening in the bottom wall of the housing and engaging a cantilevered leaf spring contact which is connected through electrical wiring to the mercury switch.

21 Claims, 6 Drawing Figures

TOILET LIGHT UNIT

SUMMARY OF THE INVENTION

This invention relates to a toilet light unit which is adapted to be mounted on a toilet for illuminating the toilet bowl when the seat is raised.

In the presently preferred embodiment, this toilet light unit has a housing with a self-adhesive layer on the bottom for attaching it to the top of the toilet bowl at the rear. A socket for a miniature lamp bulb is detachably mounted on the housing near the latter's front end. The housing has a depending front end segment which shields the lamp socket at the front and on the opposite sides and terminates in rear edges for engaging the inside rear edge of the toilet bowl. The housing has a battery compartment at its rear end. Insulative electrical wires have connections to the batteries, a terminal of the lamp socket and a mercury switch which has a self-adhesive layer on the outside for attaching it to the bottom of the toilet seat. The switch is open when the seat is down and it is closed when the seat is raised, thereby completing an energization circuit from the batteries to a lamp in the socket which shines light down into the toilet bowl.

A principal object of this invention is to provide a novel toilet light unit which is adapted to be readily installed on a variety of different toilets to provide illumination when the toilet seat is raised.

Another object of this invention is to provide such a toilet light unit which requires no structural modification of the toilet on which it is installed.

Another object of this invention is to provide a novel battery-powered toilet light unit which is compact and self-contained.

Another object of this invention is to provide a novel toilet light unit of novel construction which facilitates the replacement of any of its components which normally have a limited useful life.

Further objects and advantages of this invention will appear from the following description and appended claims, reference being had to the accompanying drawings forming a part of this specification wherein like reference characters designate corresponding parts in the several views.

DETAILED DESCRIPTION

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
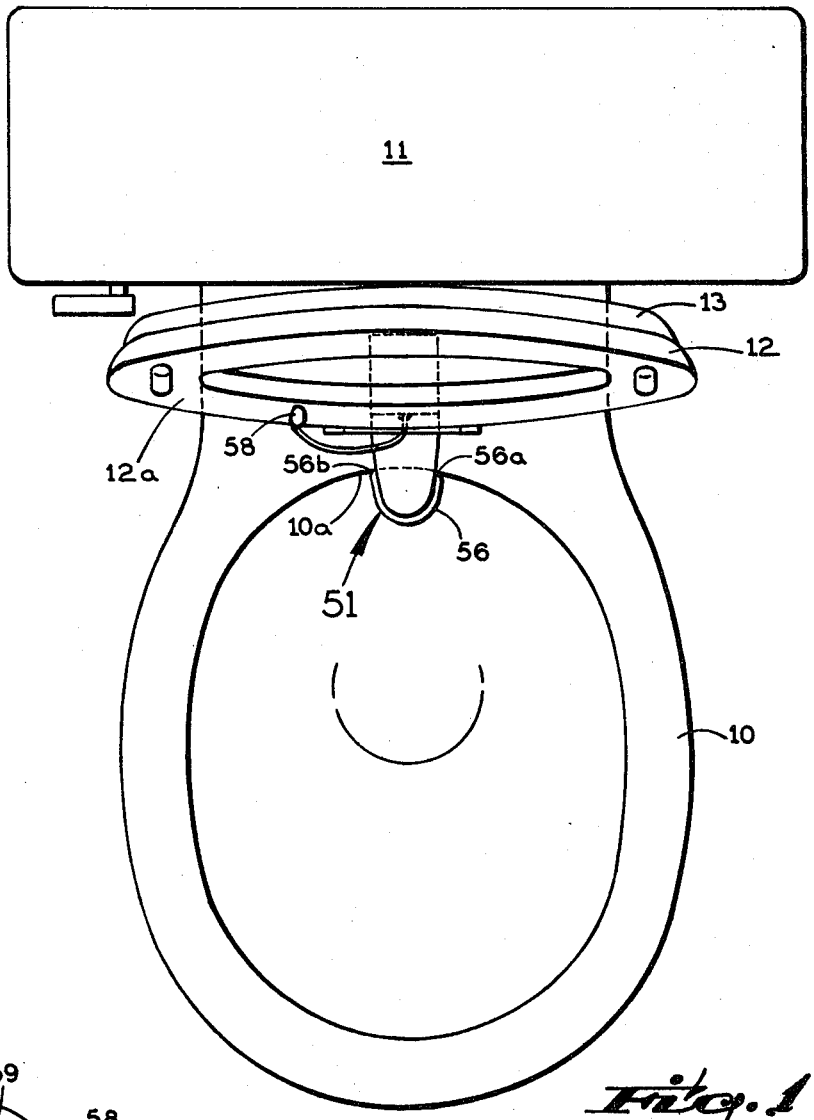
FIG. 1 is a top plan view showing the present toilet light unit installed on a toilet.

Referring first to FIG. 1, the present invention is intended for use on a toilet of conventional design having the usual toilet bowl 10, a flush tank 11 positioned behind and above the bowl, and a toilet seat 12 and seat cover 13 hingedly mounted on the bowl below the flush tank for pivotal adjustment of each between a lowered, horizontal position directly overlying the toilet bowl and a raised, substantially vertical position extending up from the toilet bowl directly in front of the flush tank 11. The present invention provides a battery-powered miniature lamp which is on when the toilet seat 12 is raised and off when the seat is lowered.

Figure 2:
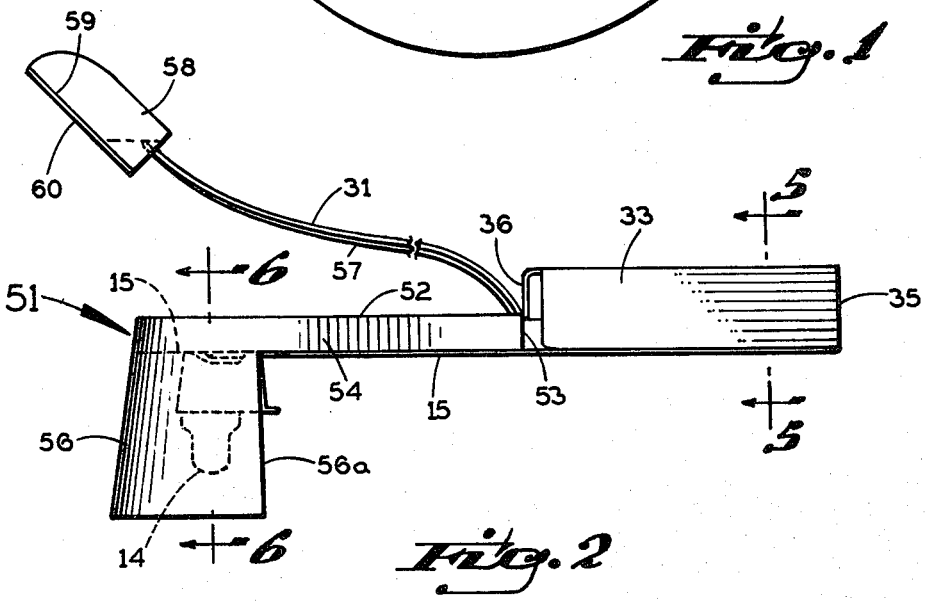
FIG. 2 is a side elevational view of the present toilet light unit.
Figure 3:
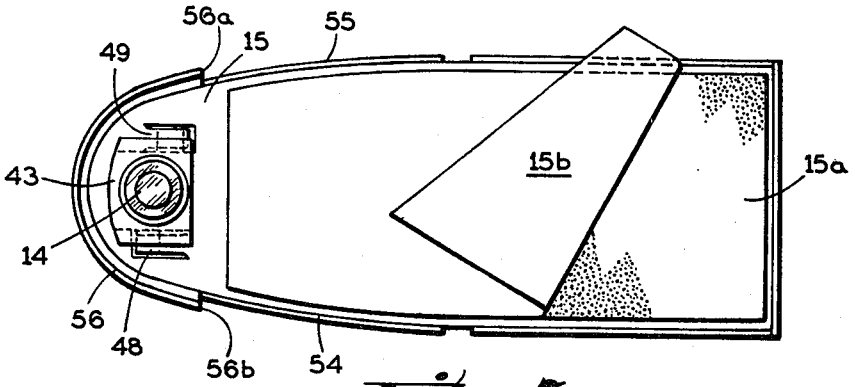
FIG. 3 is a bottom plan view of the toilet light unit showing the protective cover for the self-adhesive layer on the bottom partly peeled off.
Figure 4:
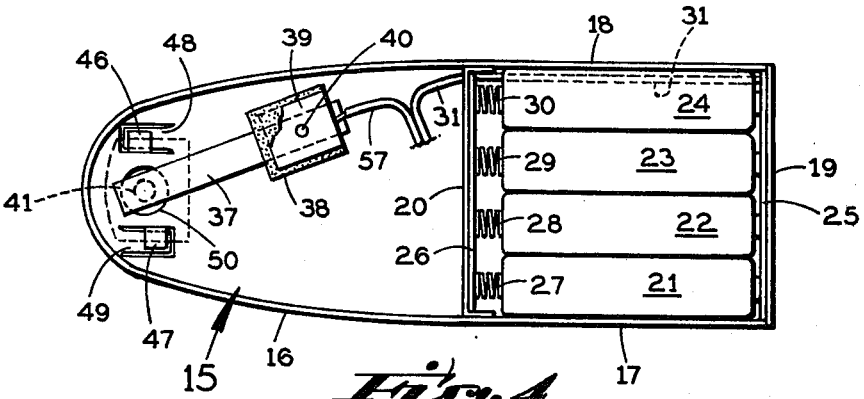
FIG. 4 is a top plan view of the toilet light unit with its top cover plates removed to show the electrical components inside.
Figure 5:
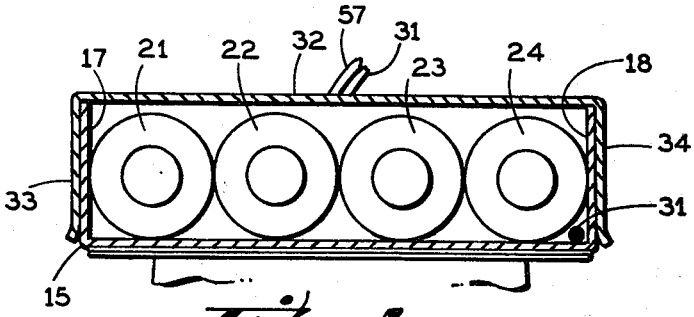
FIG. 5 i a vertical cross-section taken along the line 5—5 in FIG. 2 through the battery compartment.

Referring to FIGS. 2–6, the lamp bulb 14 is supported from a housing having a flat horizontal bottom wall 15, and a peripheral wall 16 extending up from the bottom wall a short distance and having a generally U-shaped outline, viewed from above, as shown in FIG. 4.

The housing also has two opposite flat side walls 17 and 18 extending up from its bottom wall 15 which are continuations of the opposite sides of the U-shaped peripheral wall 16, and a flat end wall 19 extending between the side walls 17 and 18 at the opposite end of the housing from the curved end of the U-shaped peripheral wall 16. The side walls 17 and 18 and the end wall 19 extend up from the bottom wall 15 substantially farther than the U-shaped peripheral wall 16. The housing has a transverse inner wall 20 extending between the opposite side walls 17 and 18 where they join the U-shaped peripheral wall 16. Wall 20 extends parallel to end wall 19 and it extends up from the bottom wall 15 the same distance as side walls 17 and 18 and end wall 19.

The vertical walls 17, 18, 19 and 20 and the part of the bottom wall 15 bounded by them define a rectangular housing recess for receiving four small batteries 21, 22, 23 and 24. In one practical embodiment these batteries are size AAA batteries with a rated voltage of 1.5 volts. An electrically conductive terminal plate 25, preferably of copper, is attached to the inside of the end wall 19 by a suitable dielectric adhesive which insulates this terminal plate from end wall 19. The same polarity terminal of each battery engages terminal plate 25. A second terminal plate 26 of copper or other high electrical conductivity material engages the inside of the opposite transverse wall 20 to provide a ground connection for the opposite terminals of the batteries. Helical copper springs 27, 28, 29 and 30 extend from the grounded terminal plate 26 into conductive engagement with the adjacent terminals of the batteries. These springs are compressed when the batteries are in place and they hold the batteries firmly against the opposite terminal plate 25. An insulated current-conducting wire 31 (FIGS. 4 and 5) extends from terminal plate 25 immediately above the bottom wall 15 of the housing and through openings at the bottom of terminal plate 26 and transverse housing wall 20.

The battery-holding recess in the housing is closed by a rear cover plate (FIG. 5) having a flat horizontal top wall 32 and depending opposite side walls 33 and 34 which extend down closely outside the housing side walls 17 and 18, respectively. The cover plate also has depending opposite end walls 35 and 36 (FIG. 2) which extend down closely outside the housing end wall 19 and the inner wall 20, respectively. The cover plate has a snug, snap-on fit over the housing walls 17-20 which surround the rectangular battery-holding recess in the housing.

On the opposite side of the transverse housing wall 20 from the battery compartment (to the left in FIG. 4) one end of an electrically conductive flat leaf spring 37 overlies a dielectric pad (not shown) which is adhesively attached to the top of the bottom wall 15 of the housing. A similar dielectric pad 38 overlies this end of the leaf spring 37. A clamping plate 39 directly overlies pad 38 and is attached to the housing bottom wall 15 by a rivet 40 to mount the leaf spring 37 in cantilever fashion.

The opposite free end of the leaf spring 37 engages the upwardly projecting terminal 41 (FIG. 6) of a socket 42 in which the screw-threaded base of the lamp bulb 14 is threadedly received. The socket terminal 41 projects up through an opening 50 in the housing bottom wall 15. In this manner the leaf spring 37 is connected electrically to the filament of the lamp bulb 14.

The socket 42 is attached to a generally channel-shaped holder having a flat horizontal bottom segment 43, opposite end legs 44 and 45 extending up from the bottom segment 43, and laterally outwardly projecting tabs 46 and 47 at the upper ends of these legs. The housing bottom wall 15 is formed with downwardly offset horizontal fingers 48 and 49 which extend snugly beneath the projecting lips 46 and 47 on the socket holder to hold them against the bottom face of housing bottom wall 15. As shown in FIG. 4, finger 48 is joined at its rear end to the housing wall 15 and is separated from (i.e., spaced below) wall 15 at its front end. Finger 49 is joined at its front end to wall 15 and is separated from wall 15 at its rear end. The socket holder may be attached to the housing by positioning its tabs 46 and 47 against the underside of the housing bottom wall 15 respectively in front of and behind the free ends of fingers 48 and 49, and then turning the holder about 45° to bring its tabs 46 and 47 into snug engagement between fingers 48 and 49 and the bottom housing wall 15. The socket holder may be detached from the housing by turning it in the reverse direction.

When the socket holder is in place, the socket terminal 41 projects up through the opening 50 in the housing bottom wall 15 enough to flex the free end of leaf spring 37 upward, so as to maintain them firmly in contact with one another.

Figure 6:
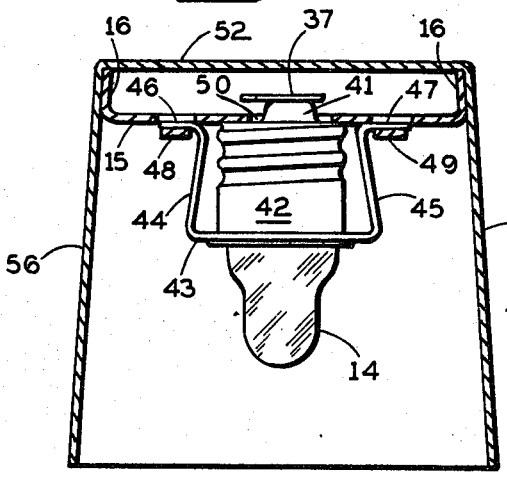
FIG. 6 is a vertical cross-section taken along the line 6—6 where the lamp bulb is located.

A front cover plate 51 (FIG. 2) overlies the leaf spring 37 and the lamp bulb 14. This cover plate has a flat horizontal top wall 52 extending to the left of the inner housing wall 20, a flat inner end wall 53 extending vertically down from the top wall 52 next to the inner housing wall 20, opposite side walls 54 and 55 extending down from the top wall 52 immediately outside the upstanding peripheral wall 16 on opposite sides of the housing, and a generally C-shaped depending end wall 56 which at its upper end is a smooth continuation of the side walls 54 and 55. As shown in FIGS. 2 and 6, this end wall 56 covers the socket 42 and the lamp bulb 14 at the front and sides and extends down well below the lower end of the lamp bulb.

As shown in FIG. 3, the flat bottom wall 15 of the housing is covered on the bottom by a self-adhesive layer **15*a* provided with a peel-off protective cover 15*b*. This adhesive layer 15*a* may be provided by tape with adhesive on its opposite faces. When the peel-off cover 15*b* is removed, exposing the adhesive layer 15*a*, the bottom wall 15 of the housing can be positioned in overlying adhesive engagement with the top of the toilet bowl 10 at the back of the toilet, as shown in FIG. 1. In this position, the vertical back edges 56*a* and 56*b* (FIGS. 2 and 5) of the curved front end wall 56 of cover plate 51 engage the inside back edge 10*a* of the toilet bowl 10 (FIG. 1), so that the lamp bulb 14** is completely enclosed except at the bottom.

A second insulated electrical conductor wire 57 is connected to the mounted end of the leaf spring 37, which connects it electrically to the filament of lamp bulb 14. The two wires 31 and 57 extend through an opening (not shown) formed in the inner end wall 53 and the top wall 52 of the front cover plate 51. The opposite ends of these wires are connected electrically to the terminals of a mercury switch 58. The mercury switch is in a housing having a flat bottom face covered by a self-adhesive layer 59 with a peel-off cover 60. When the cover 60 is removed, the adhesive layer 59 enables the mercury switch 58 to be attached to the bottom **12*a* of the toilet seat 12. This adhesive layer may be in the form of double-faced adhesive tape. The wires 31 and 57 are flexible and long enough to permit the toilet seat 12 to be raised and lowered in the usual manner. When the toilet seat is raised, the mercury switch is closed and the lamp bulb 14 is on. When the seat is lowered, the mercury switch is open and the lamp bulb 14** is off.

From the foregoing description and the accompanying drawings it will be evident that the present invention is a self-contained, compact unit which is adapted for mounting on a wide variety of toilets and is operative to illuminate the toilet bowl whenever the seat is up. No modification of the toilet or toilet seat is required for the present unit to be installed, and it can be removed without difficulty at the adhesive layers **15*a* and 59. If desired, the mercury switch 58 may be replaced by another type of position-responsive switch or by a manually-operated switch which the user may operate to turn on the lamp bulb 14** after raising the seat. Also, if desired, the lamp bulb may be connected through a step-down transformer and an extension cord to an A.C. power socket in the bathroom, although battery operation is considered preferable because it makes the unit entirely self-contained.

We claim:

1. A toilet light unit comprising:

a housing having means thereon for mounting it on top of a toilet bowl at the back;

and a lamp socket mounted on said housing to extend down in front of the rear inner edge of the toilet bowl when said housing is mounted on top of the toilet bowl at the back;

said housing having a depending front end segment extending down in front and on opposite sides of said socket;

said housing having a bottom wall with an opening therein;

said socket having an electrical terminal at its upper end which projects up through said opening; and an electrically conductive leaf spring mounted in cantilever fashion at its rear end on said bottom wall of the housing and having its front end overlying said opening and resiliently engaging said socket terminal.

2. A toilet light unit according to claim 1, wherein said means for mounting the housing is a self-adhesive layer on the bottom of the housing.

3. A toilet light unit according to claim 1, wherein said depending front end segment of the housing terminates on its opposite sides in rearwardly-facing edges for engagement with the rear inner edge of the toilet bowl.

4. A toilet light unit according to claim 3, wherein:
said housing presents a flat bottom wall extending behind said depending front end segment;
and said means for mounting the housing is a self-adhesive layer on said bottom wall.

5. A toilet light unit according to claim 4, and further comprising a holder for said lamp socket removably attachable to said bottom wall of the housing inside said depending front segment of the housing.

6. A toilet light unit according to claim 1, and further comprising:
a first insulated electrical wire connected electrically to said leaf spring at its mounted end;
means defining a battery compartment in said housing above the latter's bottom wall;
a second insulated electrical wire extending from said battery compartment;
and a mercury switch connected between said first and second wires, said switch having a self-adhesive layer thereon for attaching it to the bottom of the toilet seat to position the switch to close when the seat is raised and to open when the switch is lowered.

7. A toilet light unit according to claim 1, and further comprising a holder for said lamp socket removably attached to said housing inside said depending front segment of the housing.

8. A toilet light unit according to claim 1, and further comprising a holder for said lamp socket removably attached to said bottom wall of the housing inside said depending front segment of the housing.

9. A toilet light unit according to claim 1, and further comprising:
an electrical switch;
means for mounting said switch on a toilet seat which may be lowered onto the toilet bowl or raised up from the toilet bowl;
and electrical wiring connecting said switch between said lamp socket and a power source.

10. A toilet light unit according to claim 9, wherein:
said housing defines a battery compartment having a terminal therein;
and said electrical wiring is connected to said terminal in the battery compartment.

11. A toilet light unit according to claim 9, wherein said switch is a mercury switch operative to close when the toilet seat is raised and to open when the toilet seat is lowered.

12. A toilet light unit according to claim 11 wherein said means for mounting said switch is a self-adhesive layer on the outside of said switch.

13. A toilet light unit according to claim 12, wherein:
said housing defines a battery compartment having a terminal therein:
and said electrical wiring is connected to said terminal in the battery compartment.

14. A toilet light unit according to claim 13, wherein said means for mounting the housing is a self-adhesive layer on the bottom of the housing.

15. A toilet light unit according to claim 14, wherein said depending front end segment of the housing terminates on its opposite sides in rearwardly-facing edges for engagement with the rear inner edge of the toilet bowl.

16. A toilet light unit according to claim 15, and further comprising a holder for said lamp socket removably attachable to said bottom wall of the housing inside said depending front segment of the housing.

17. A toilet light according to claim 16, and further comprising:
a pair of laterally spaced fingers, each attached at one end to said bottom wall of the housing and offset downward from the bottom wall and terminating in an opposite free end spaced closely below said bottom wall;
and wherein:
said holder for the socket has a pair of laterally outwardly projecting tabs at its upper end, each of which is snugly insertable slidably between a corresponding finger and the bottom wall at said free end of the corresponding finger.

18. A toilet light unit according to claim 17, wherein:
one of said fingers is attached at its rear end to the bottom wall of the housing;
and the other of said fingers is attached at its front end to the bottom wall of the housing.

19. A toilet light unit comprising:
a housing having a depending front end segment and a flat bottom wall extending behind said depending front end segment, a self-adhesive layer on said bottom wall for attaching said housing to the top of a toilet bowl at the back, said depending front segment of the housing terminating on its opposite sides in rearwardly-facing front edges for engagement with the rear inner edge of the toilet bowl;
a lamp socket holder removably attachable to said bottom wall of the housing inside said depending front end segment of the housing;
a pair of laterally spaced fingers, each attached at one end to said bottom wall of the housing and offset downward from the bottom wall and terminating in an opposite free end spaced closely below said bottom wall;
said socket holder having a pair of laterally outwardly projecting tabs at its upper end, each of which is snugly insertable slidably between a corresponding finger and the bottom wall at said free end of the corresponding finger;
and a lamp socket mounted in said holder to extend down in front of the rear inner edge of the toilet bowl when said housing is mounted on top of the toilet bowl at the back;
said depending front end segment of the housing extending down in front of and on opposite sides of said socket.

20. A toilet light unit according to claim 19, wherein:
one of said fingers is attached at its rear end to the bottom wall of the housing;
and the other of said fingers is attached at its front end to the bottom wall of the housing.

21. A toilet light unit according to claim 20, wherein:
said socket has an electrical termina! at its upper end which projects up beyond said tabs on the socket holder;
and said bottom wall of the housing has an opening located midway between said fingers which passes said socket terminal;
and further comprising:
an electrically conductive leaf spring mounted in cantilever fashion at its rear end on said bottom wall of the housing and having its front end overlying said opening and resiliently engaging said socket terminal.

* * * * *